United States Patent [19]

Ucci

[11] Patent Number: 4,643,930

[45] Date of Patent: Feb. 17, 1987

[54] NOVEL CARPETS WITH YARNS COATED WITH FLUOROCARBON AND ADHESIVE CONTAINING FLUOROCARBON

[75] Inventor: Pompelio A. Ucci, Pensacola, Fla.

[73] Assignee: Monsanto Company, St. Louis, Mo.

[21] Appl. No.: 740,453

[22] Filed: Jun. 3, 1985

Related U.S. Application Data

[63] Continuation of Ser. No. 642,021, Aug. 20, 1984, abandoned.

[51] Int. Cl.[4] ..... B32B 3/02

[52] U.S. Cl. ..... 428/96; 428/95; 428/97

[58] Field of Search ..... 428/95, 96, 97

[56] References Cited

U.S. PATENT DOCUMENTS

| | | | |
|---|---|---|---|
| 4,112,161 | 9/1978 | Sorrello | 428/97 |
| 4,264,484 | 4/1981 | Patel | 428/97 |
| 4,346,141 | 8/1982 | Remington | 428/96 |
| 4,355,065 | 10/1982 | De Mott | 428/95 |
| 4,401,704 | 8/1983 | Zegota | 428/96 |

*Primary Examiner*—Marion C. McCamish

*Attorney, Agent, or Firm*—John W. Whisler

[57] ABSTRACT

Carpets having stain resistant pile fibers and a backing that is substantially impervious to water are described. The imperviousness of the backing prevents water from passing through the carpet and into the underpad where its presence causes rotting and mildewing of the underpad and carpet components, and thus, permits the carpet to be washed with generous amounts of water without wetting the underpad. Also, aqueous substances which spill onto the carpet will not penetrate the carpet and wet the underpad.

5 Claims, No Drawings

NOVEL CARPETS WITH YARNS COATED WITH FLUOROCARBON AND ADHESIVE CONTAINING FLUOROCARBON

This is a continuation of application Ser. No. 642,021, filed Aug. 20, 1984, now abandoned.

BACKGROUND OF THE INVENTION

A. Field of the Invention

This invention relates to carpet comprising a primary backing and a pile consisting of fibers attached to the primary backing. More specifically, the invention relates to carpet that resists soiling and is substantially impervious to water. By "substantially impervious to water" is meant that when one gallon (3785 ml) of water is poured onto the facing of the carpet from a height of less than 3 centimeters and allowed to stand for sixty (60) hours, less than 300 ml or (8%) of the water passes through the primary backing of carpet.

The term fiber as used herein includes fibers of extreme or indefinite length (i.e., filaments) and fibers of short length (i.e., staple). The term yarn as used herein means a continuous strand of fibers.

B. Description of the Prior Art

The typical carpet for residential applications is a wall-to-wall carpet which has a primary backing material, such as polypropylene or jute, stitched with closely spaced erect loops or cut loops of polyamide yarn which extend upwardly from the backing to form a tufted structure (i.e., pile). The underside of the primary backing is coated with an adhesive composition. The adhesive anchors the tufts in the primary backing and is applied to the backing in the form of a latex compounded emulsion which is then dried with heat to cure the adhesive. In most instances, a secondary backing is applied to the underside of the primary backing before the adhesive is dried and cured. The typical carpet is normally installed with an underpad being placed between the carpet and floor. The underpad enhances the cushioning effect and wear-life of the carpet. The carpet and underpad are referred to herein as the carpet system. Usually, the polyamide yarn is coated with a fluorochemical, either before or after the carpet is made, to enhance the soil resistant and soil repellant properties of the carpet.

The typical carpet system is vulnerable to water. Water which spills or otherwise comes into contact with the exposed surface (i.e. facing) of the carpet quickly wets the pile, passes through the primary backing, adhesive composition, secondary backing, and is absorbed by the underpad which serves as a reservoir for the water. Drying of the carpet system, on the other hand, is a slow process in which moisture slowly migrates upwardly from the underpad back through the components of the carpet system to the facing where it then evaporates into the surrounding atmosphere. (The drying time can be lessened somewhat by use of air driers, towels, sponges, vacuums, etc. to remove moisture from the facing.) In the meantime, however, the presence of moisture in the carpet system components causes mildew and rotting of the components as well as any wooden floors in contact with the underpad. In the case of urine, there is the additional problem, namely, that of a prolonged and offensive odor. In the case of an artificially-colored soft drink which stains the carpet, the staining of the carpet persists until the drying process is completed, for example, while the soft drink can be immediately sponged from the carpet facing, drink when stored in the underpad will slowly but continually work its way upward from the underpad and restain the facing.

The vulnerability of the typical carpet system to water and water based substances gives rise to a very real dilemma, namely, that of washing the carpet. Normally, if a sufficient amount of water is used to effectively wash stains, soil and odors from the carpet, a portion of the water passes through the carpet and is absorbed by the underpad which is undesirable for reasons given above. On the other hand, if water is sparingly used so as to prevent it from getting down into the underpad, effective cleaning of the carpet often is not possible. Therefore, even though carpet fibers are treated with fluorochemicals for the purpose of making the typical carpet system more resistant to soiling and staining, as a practical matter, once the carpet has been stained or soiled, there is no easy way to effectively remove the stain or soil from the carpet without wetting the underpad and creating yet another and, perhaps, even a more serious problem.

SUMMARY OF THE INVENTION

The present invention provides carpet that resist soiling and is substantially impervious to water. According to the preferred embodiment of the invention the carpet comprises a primary backing that is substantially impervious to water and a pile consisting essentially of fibers attached thereto, wherein the fibers are coated with an effective amount of a fluorochemical suitable to improve the soil resistance of the carpet.

The carpet of the present invention eliminates the above-mentioned problems associated with corresponding prior art carpets. An important feature of the carpet is that it is both soil resistant and substantially impervious to water. For example, if the carpet were impervious to water but not soil resistant, an aqueous solution of a soiling substance coming into contact with the carpet would spread out over a greater area of carpet and soil the carpet to a greater extent than if the carpet were not impervious to water. On the other hand, if the carpet were soil resistant but not impervious to water, it would be difficult to effectively wash soil from the carpet without wetting the underpad. Also, since the carpet is impervious to water, urine which often comes into contact with carpet in households frequented by infants and house pets cannot penetrate and be absorbed and stored in the underpad and other components of the carpet system.

PREFERRED EMBODIMENTS OF THE INVENTION

The carpet of the invention may be constructed in a conventional manner. According to a preferred embodiment of the invention, the carpet is a cut pile tufted nylon carpet and is made in a conventional manner using commercially available materials, namely, nylon 66 or nylon 6 fibers in the form of a two-ply, staple or continuous filament carpet yarn, jute or polypropylene backing materials and a conventional carpet backing adhesive composition with the exception that (1) the adhesive composition contains a fluorochemical in an amount sufficient to render the backing a barrier to liquids and (2) the fibers are coated either before or after tufting with an effective amount of a fluorochemical suitable to improve the soil resistance of the carpet.

Adhesive compositions which may be used in providing the carpet of the present invention comprise a mixture of a latex of a synthetic polymer known to be usable for binding tufts of fiber in carpet primary backings, filler (e.g. $CaCO_3$) and other additives (e.g. thickeners, fungicides, etc.). Such polymers are capable of being prepared in uniform aqueous colloidal dispersions having spherical particles averaging 0.2 microns in diameter and include, but are not limited to, polyvinyl acetates, polyacrylates, polyethylene-vinylacetate copolymer, styrene-butadiene copolymers (SBR) and/or carboxy styrene-butadiene copolymers.

Fluorochemicals which may be added to the adhesive composition and which may be used to coat the polyamide fibers in accordance with the present invention are commercially available and include those available from Minnesoate Mining and Manufacturing Company under the tradename Scotchgard ®, such as, Scotchgard 352, from E. I. DuPont de Nemours and Company under the tradename Teflon and from American Hoechst Corporation under the tradename Nuva ®. The same fluorochemical may be used for both applications.

It has been found that the amount of fluorochemical required to provide a primary backing that is substantially impervious to water will depend on the particular fluorochemical and adhesive composition selected. In general, amounts ranging from 0.1 to 1.0% by weight of the fluorochemical, based on weight of adhesive composition, are sufficient with amounts ranging from 0.2 to 0.4% by weight usually being sufficient. Preferably, as little of the fluorochemical as possible is used in order to minimize the overall cost of the carpet. Instead of rendering the backing impervious to water by adding an effective amount of fluorochemical to the adhesive composition, it is contemplated that other means could be used to accomplish an equivalent result, for example, coating the backing with a water-impervious film such as an ethylene-vinylacetate copolymeric film.

In general, the soil resistance of polyamide fibers coated with a suitable fluorochemical improves as the concentration of the fluorochemical increases up to a point and thereafter improves very little, if any. In commercial applications the polyamide fibers are coated with from 200 to 800 ppm of the fluorochemical, based on the weight of fiber (o.w.f.). Again, as little of the fluorochemical as possible is used in order to minimize the overall cost of the carpet. The fluorochemical coating may be applied to the fibers, either before or after tufting by conventional techniques, for example by applying the fluorochemical to the fibers from an aqueous medium and then drying the yarn to remove liquid and provide a fluorochemical coating on the yarn surface. According to one embodiment, the medium is an aqueous spin finish and is applied to the fibers during melt spinning of the fibers while the fibers are in the form of continuous filament yarn. In this embodiment, the yarn after it is quenched is passed over a freely rotating roll (finish roll) partially immersed in the spin finish. The yarn is then subjected to conditions of time and temperature sufficient to dry the yarn before it is collected. Normally, when the fluorochemical is applied to the yarn from a spin finish during preparation of the yarn, no extra heating steps are required to dry the yarn. The resulting yarn then can be processed into continuous filament yarn or staple yarn. According to another embodiment fluorochemical-containing aqueous medium is applied to the finished carpet, for example, by spraying an appropriate amount of the medium onto the carpet, and then the carpet is dried, for example in an oven to provide the fluorochemical coated fibers.

Fibers which may be used in providing the carpet fabric of the present invention, include polyamide, polyester, polyolefin and acrylic fibers, with polyamide fibers being preferred for making the carpet fabric and, especially, nylon 66 (i.e. polyhexamethylene adipamide) fibers and nylon 6 (i.e. polycaprolactam) fibers. Other polyamides fibers include fibers of: nylon 11 which is the polymer of 11-amino undecanoic acid; nylon 610 which is polyhexamethylene sebacamide; and copolymers of nylon 66 or nylon 6 in which a portion of the nylon 66 or nylon 6 monomers are replaced by other monomers copolymerizable therewith, for example, a nylon66/6 copolymer or nylon 66/6TA copolymer where 6TA is hexamethylene terephthalamide.

EXAMPLE

This example illustrates the preparation of carpet of the present invention and compares the carpet to conventional carpet.

A 310 filament, 60 denier per filament (dpf), undrawn nylon 66 yarn was prepared by conventional procedures. Fifty-four (54) such yarns were combined to form a tow having a total denier of about 1,000,000. The tow was drawn over rolls to provide nominal 18 dpf tow, crimped in a conventional stuffer box and cut into 7½ inch (19.05 cm) staple. The staple was carded, drafted and spun on a conventional ring spinning frame to provide a 2½ cotton count yarn having about 4.5 tpi (177 tpm) of twist in the Z-direction. Two of these yarns were plied on a conventional ring twister to provide a plied yarn having a net twist of 0 tpi in the Z-direction and 3 tpi (118 tpm) in the S-direction. The resulting plied yarn was then heatset. Cut pile carpet was made by tufting the heatset plied staple yarn into a polypropylene primary backing in a conventional manner. The carpet was then dyed to a light gold color in a conventional beck dyeing operation in which the carpet was immersed in an aqueous dye bath contained within a vessel. The carpet backing adhesive composition used in making the carpet was a carboxy styrene-butadiene latex obtained commercially from Textile Rubber and Chemical Company under the designation L-1243 to which had been added with stirring 0.25% by weight, based on the weight of the latex, of a fluorochemical obtained commercially from Minnesota Mining and Manufacturing Company under the tradename Scotchgard 352. The resulting latex was applied to the primary backing of the carpet in a conventional manner in an amount of 25–60 oz./yd$^2$ of carpet and then a secondary backing was applied to the primary backing before the adhesive was dried and cured.

One gallon (3785 ml) of water was poured onto a sample of the above-identified carpet (invention) from a height of less than 3 centimeters and allowed to stand for 60 hours. After the 60-hour period, examination of the carpet sample revealed that during the 60-hour period only 90 ml of water had passed through the carpet sample. For purposes of comparison, one gallon (3785 ml) of water was also similarly poured onto a sample of store-bought carpet (control). The carpet was similar in construction to the above invention carpet sample. After 20 minutes, examination of this sample revealed that 2000 ml of water had already passed through the control carpet sample.

The carpet samples (control and invention) were also subjected to floor testing in which carpet samples were placed in an area where human traffic was heavy and were left until each sample had been subjected to 50,000 traffics, a traffic occurring each time a human walks across the carpet. All the tested samples were badly soiled. Some of the control samples and some of the invention samples were cleaned with commercial equipment utilizing hot water with detergent. The remaining control and invention samples were washed with generous amounts of water and detergent. The restorability of the samples washed with generous amounts of water and detergent was excellent, whereas the samples cleaned with the commercial equipment did not approach the restorability of the other samples. Examination of the carpet samples revealed that during the cleaning and washing of the invention samples the primary backings served as a barrier to water whereas substantial amounts of water penetrated the primary backing of the control samples. Thus, in the absence of a carpet system having a primary backing that is substantially a barrier to water, the use of generous amounts of water to clean the facing of the carpet system would be detrimental and illadvised.

I claim:

1. A carpet comprising a primary backing stitched with closely spaced loops or cut loops of nylon 6 or nylon 66 yarn which extend upwardly from the top surface of the primary backing to form a pile, wherein the underside of the primary backing is coated with a carpet backing adhesive composition, characterized in that said yarn is coated with a sufficient amount of a fluorochemical to improve the soil resistance of the carpet and said adhesive composition contains a fluorochemical in an amount sufficient to render said primary backing substantially impervious to water.

2. The carpet of claim 1 wherein said adhesive composition includes a carboxy styrene-butadiene latex.

3. The carpet of claim 1 wherein said fibers are nylon 66 fibers.

4. The carpet of claim 3 wherein said fibers are staple fibers.

5. The carpet of claim 1 wherein the carpet includes a secondary backing.

* * * * *